US006441330B2

(12) United States Patent
Liao

(10) Patent No.: US 6,441,330 B2
(45) Date of Patent: Aug. 27, 2002

(54) KEYBOARD CIRCUIT USING CONDUITS WITHIN A BUS FOR AIR FLOW

(75) Inventor: Pin-Chien Liao, Tao-Yuan Hsien (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/858,650

(22) Filed: May 17, 2001

(30) Foreign Application Priority Data

Jun. 2, 2000 (TW) ..... 089111095

(51) Int. Cl.[7] ..... H01H 1/10
(52) U.S. Cl. ..... 200/515; 200/5 A
(58) Field of Search ..... 200/5 A, 512, 200/513–517, 306; 345/168; 400/491, 491.1

(56) References Cited

U.S. PATENT DOCUMENTS 4,701,579 A * 10/1987 Kurachi et al. ..... 200/5 A
5,218,177 A * 6/1993 Coleman et al. ..... 200/5 A
5,981,890 A * 11/1999 Chen ..... 200/515
6,259,434 B1 * 7/2001 Tsai ..... 200/243

* cited by examiner

*Primary Examiner*—Elvin Enad
*Assistant Examiner*—M. Fishman
(74) *Attorney, Agent, or Firm*—Winseon Hsu

(57) ABSTRACT

A thin film circuit includes a thin film switching circuit with an upper circuit layer including at least one upper joint, and a lower circuit layer including at least one lower joint corresponding to the upper joint. The lower circuit layer is set under the upper layer, and an air-filled space is disposed between the upper joint and the lower joint. The thin film switching circuit further includes at least one first air conduit set between the upper circuit layer and the lower circuit layer and connected to the air-filled space, and at least one bus structure connected to the thin film switching circuit and extending out of the thin film switching circuit to transmit electrical signals of the thin film switching circuit. The bus structure includes at least one second air conduit. One end of the second air conduit is connected to ambient atmosphere, and the other end of the second air conduit is connected to the first air conduit so that the air in the air-filled space can flow in and out to the ambient atmosphere through the first air conduit and the second air conduit.

13 Claims, 10 Drawing Sheets

KEYBOARD CIRCUIT USING CONDUITS WITHIN A BUS FOR AIR FLOW

BACKGROUND OF THE INVENTION

1. Field of the Invention

The present invention relates to a keyboard circuit, and more particularly, to a keyboard circuit using conduits within a bus for air flow.

2. Description of the Prior Art

Please refer to FIG. 1 and FIG. 2. FIG. 1 is an exploded diagram of a prior art circuit board 10 for a keyboard 12, and FIG. 2 is a cross-sectional view of the circuit board 10. The circuit board 10 for the keyboard 12 is used to generate key signals. The keyboard 12 includes a base 14 and a plurality of key structures 16. The circuit board 10, disposed between the base 14 and the key structures 16, includes a thin film switching circuit 18 for generating key signals. The thin film switching circuit 18 includes an upper circuit layer 22 and a lower circuit layer 24.

As shown in FIG. 2, the upper circuit layer 22 includes a plurality of upper joints 26 corresponding to a plurality of lower joints 28 of the lower circuit layer 24. The key structures 16 are disposed over all sets of the upper joints 26 and the lower joints 28, and are movable in an upward and downward manner. Thus, the upper joints 26 are capable of being pressed down by the key structures 16 to cause the upper joints 26 to contact their respective lower joint 28 to generate corresponding key signals. An air-filled space 30 is between the upper joints 26 and the lower joints 28. When the key structures 16 are pushed downward, the upper joints 26 descends and contacts the lower joints 28; the upper joints 26 are designed to maintain or return to the original positions when the key structures 16 are not pressed or released.

Generally, there are two ways of designing the air-filled space 30. The first method is to isolate the air-filled space 30 to prevent dust and moisture from entering the air-filled space 30. This prolongs the life of the circuit board 10, but the upper joints 26 may become hard to be pressed down by the key structures 16 or to revert to the original positions when the outside atmosphere pressure or temperature varies. The user, thus, may felt inconvenient. Moreover, the circuit board 10 may generate incorrect key signals. The other method is to let the air-filled space communicated with the atmosphere to equalize internal and external pressures. This, however, leaves the circuit board 10 open to the atmosphere and cannot stop effectively the entering of external dust and moisture.

Please refer to FIG. 3. FIG. 3 is a schematic diagram of another prior art circuit board 32 designed to overcome the aforementioned problems. As shown in FIG. 3, a plurality of air passageways 33 are connected to a restrictive air passageway 34 that has a superior blocking effect than a device with air passageways 33 that are directly open to the outside.

Both the air passageways 33 and the restrictive air passageway 34 have openings on the thin film switching circuit 18, and so dust and moisture is able to enter the air-filled spaces 30. For example, if a user spills hot liquid on the thin film switching circuit 18, the air within the air-filled space 30 expands from the heat, leaving the air-filled spaces 30, and returns when the liquid cools down. Therefore, the liquid may be sucked through the restrictive air passageway 34 and the air passageways 33 into the air-filled spaces 30 when the liquid cools down. Therefore, the circuit boards 10 and 32 do not always satisfy the user's wants.

SUMMARY OF THE INVENTION

It is therefore an objective of the present invention to provide a circuit board for a keyboard that not only adjusts the air pressure of the air-filled spaces within the keyboard, but also prevents dust and moisture from entering the air-filled spaces.

In accordance with the claimed invention, a thin film circuit includes a thin film switching circuit with an upper circuit layer including at least one upper joint, and a lower circuit layer with at least one lower joint corresponding to the upper joint. The lower circuit layer is set under the upper layer, and an air-filled space is disposed between the upper joint and the lower joint. The thin film switching circuit further includes at least one first air conduit set between the upper circuit layer and the lower circuit layer that is connected to the air-filled space. At least one bus structure is connected to the thin film switching circuit and extends out of the thin film switching circuit to transmit electrical signals from the thin film switching circuit. The bus structure includes at least one second air conduit. One end of the second air conduit is connected to the ambient atmosphere. The other end of the second air conduit is connected to the first air conduit so that the air in the air-filled space can flow in and out to the ambient atmosphere through the first air conduit and the second air conduit.

It is an advantage of the present invention that because the air in the air-filled spaces is able to flow in and out to the ambient atmosphere through the first air conduit and the second air conduit, the keyboard circuit is able to adjust pressure according to variations of the ambient atmosphere while preventing contaminants, such as dust or moisture, from entering the keyboard circuit.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
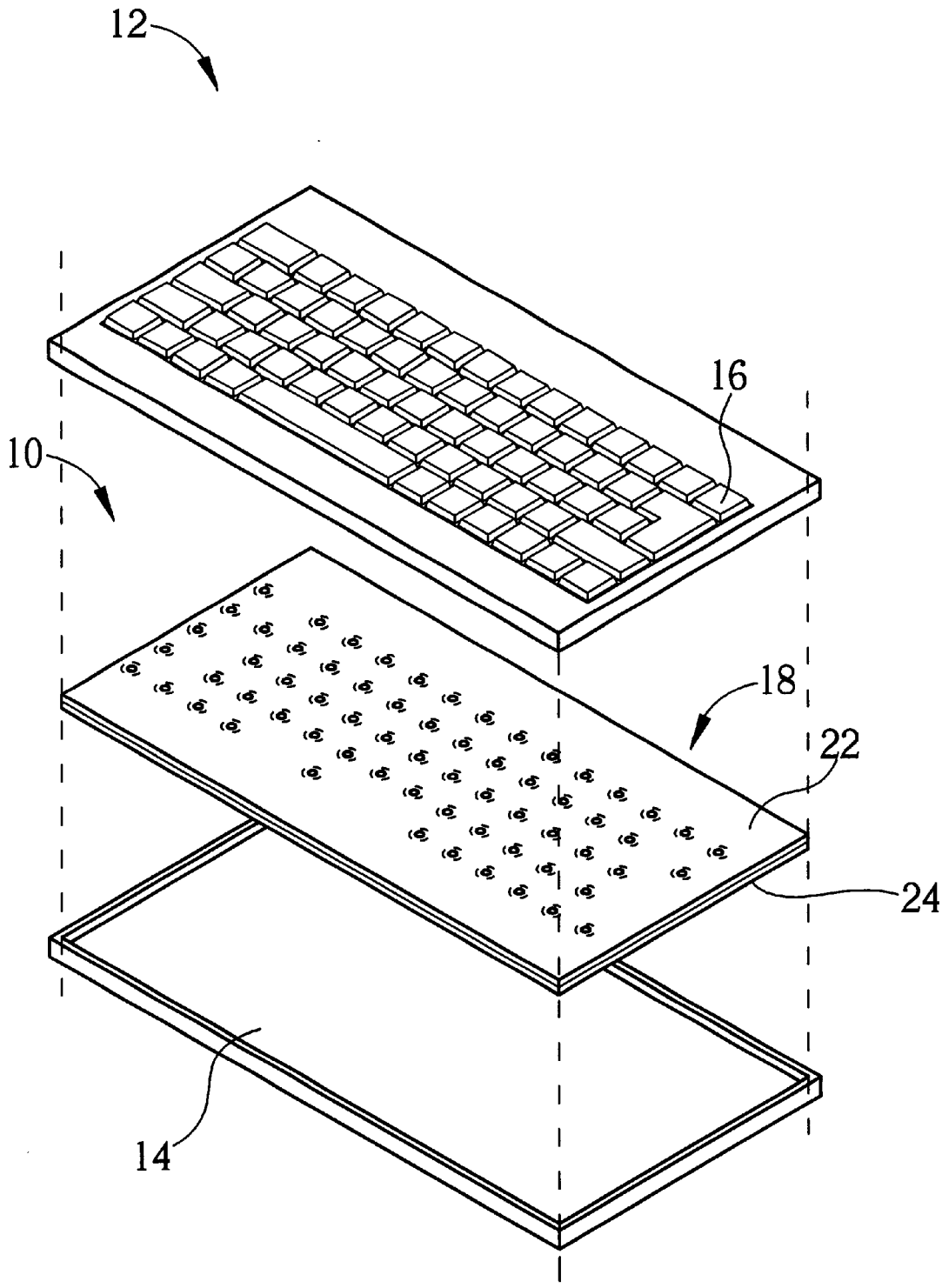
Fig. 1 Prior art
FIG. 1 is a schematic diagram of an exploded view of a prior art keyboard.
Figure 2:
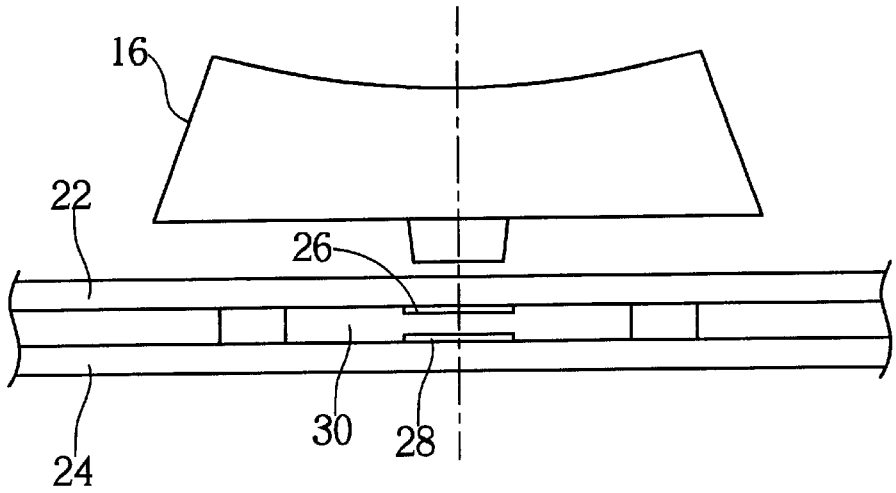
Fig. 2 Prior art
FIG. 2 is a sectional view of the keyboard shown in FIG. 1.
Figure 3:
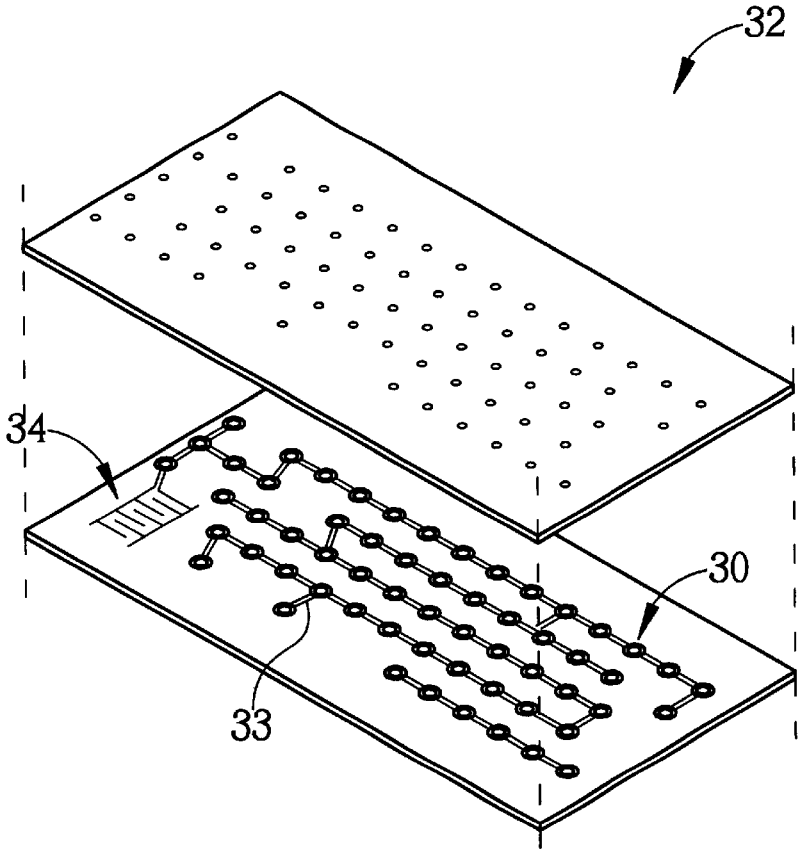
Fig. 3 Prior art
FIG. 3 is a schematic diagram of another prior art circuit board for a keyboard.
Figure 4:
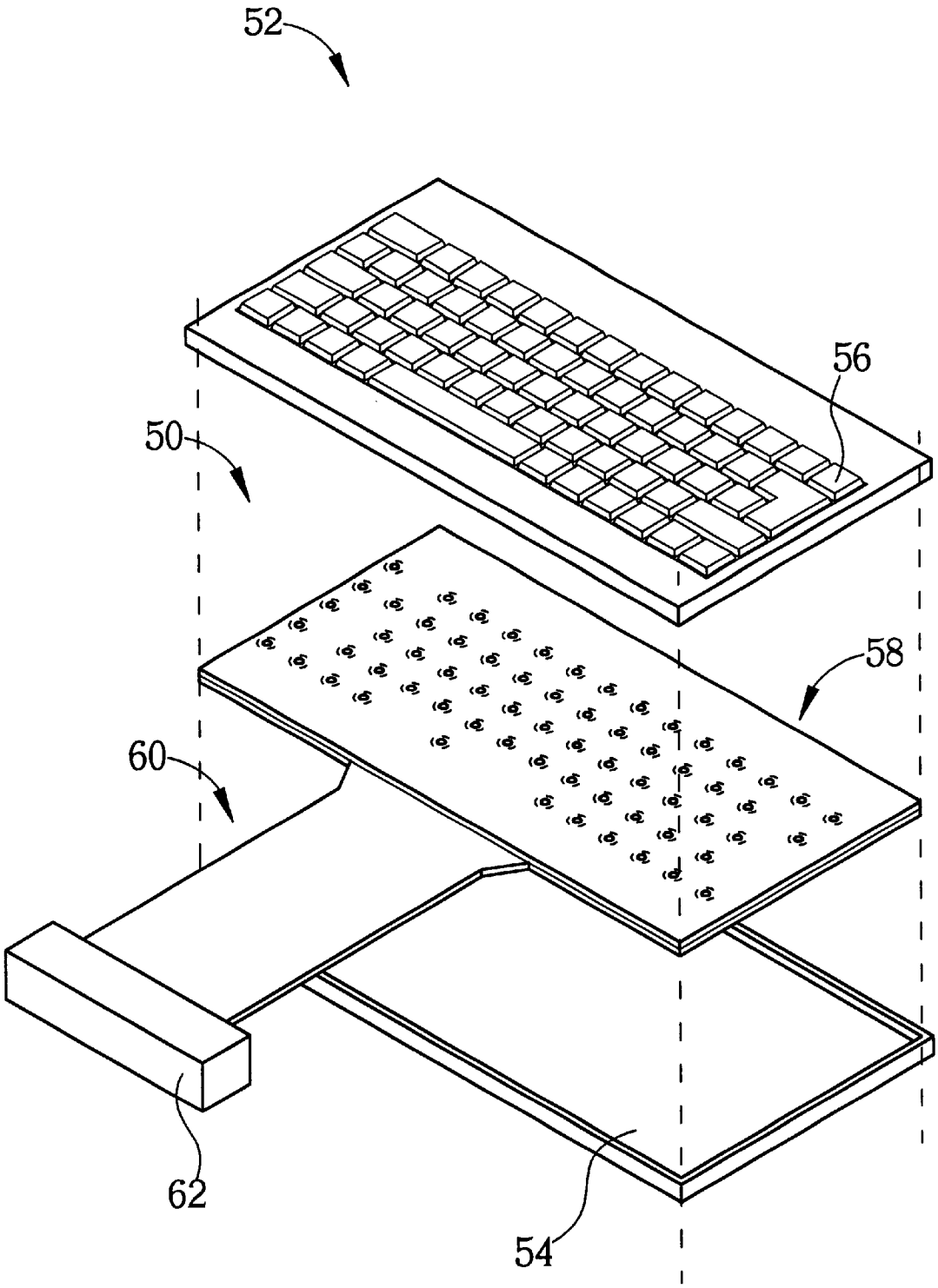
FIG. 4 is an exploded view of a keyboard according to the present invention.

Please refer to FIG. 4. FIG. 4 is an exploded view of a keyboard 52 according to the present invention. The keyboard 52 includes a base 54, a circuit board 50, and a plurality of key structures 56. The circuit board 50 is se t between the base 54 and the key structures 56. The circuit board 50 includes a thin film switching circuit 58 for generating key signals, and a bus structure 60 connected to the thin film switching circuit 58. The bus structure 60 extends out from the circuit board 50 to transmit the key signals from the thin film switching circuit 58 to a signal receiver 62.

Figure 5A:
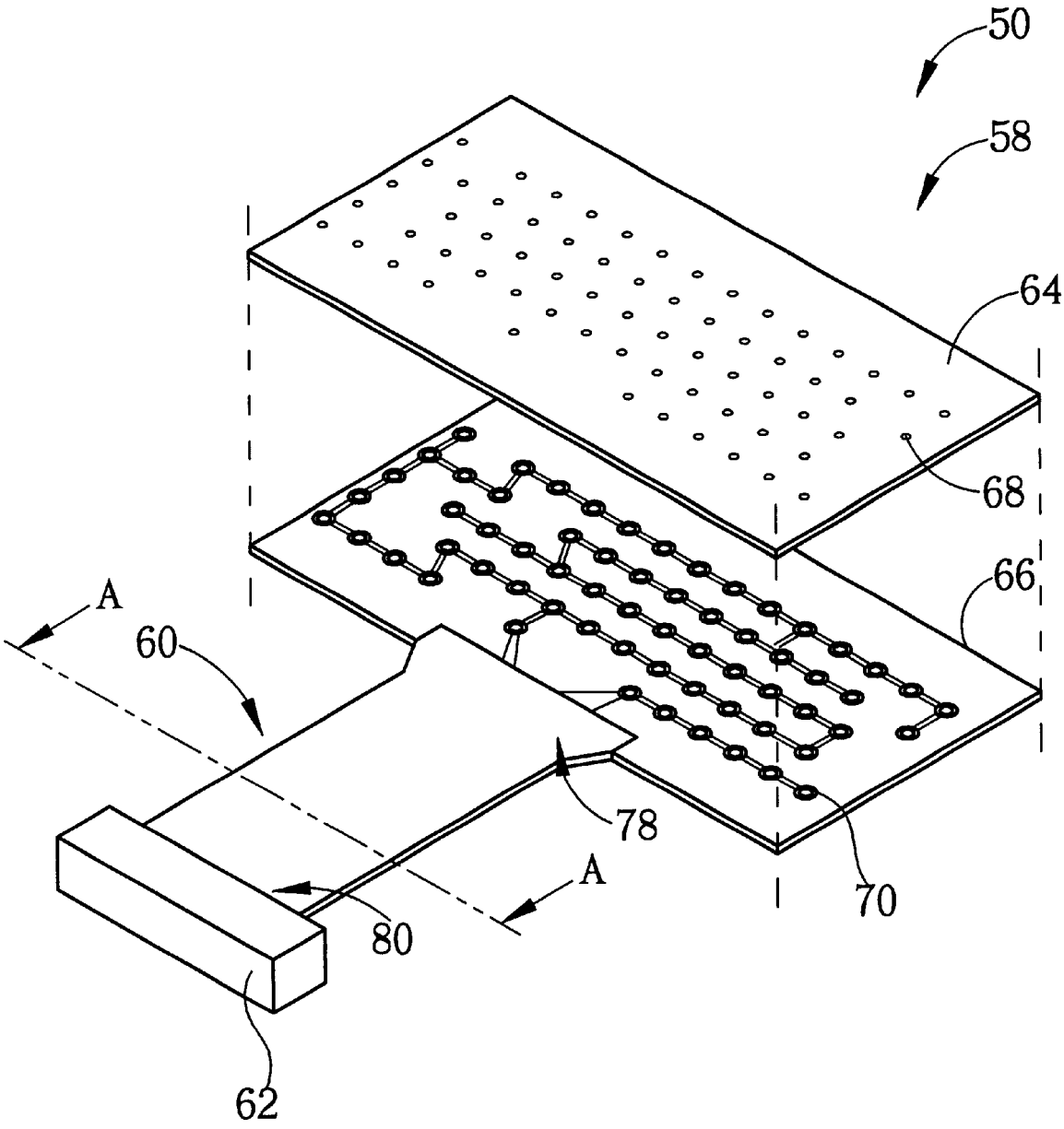
FIG. 5A is an exploded view of a circuit board shown in FIG. 4.
Figure 5B:
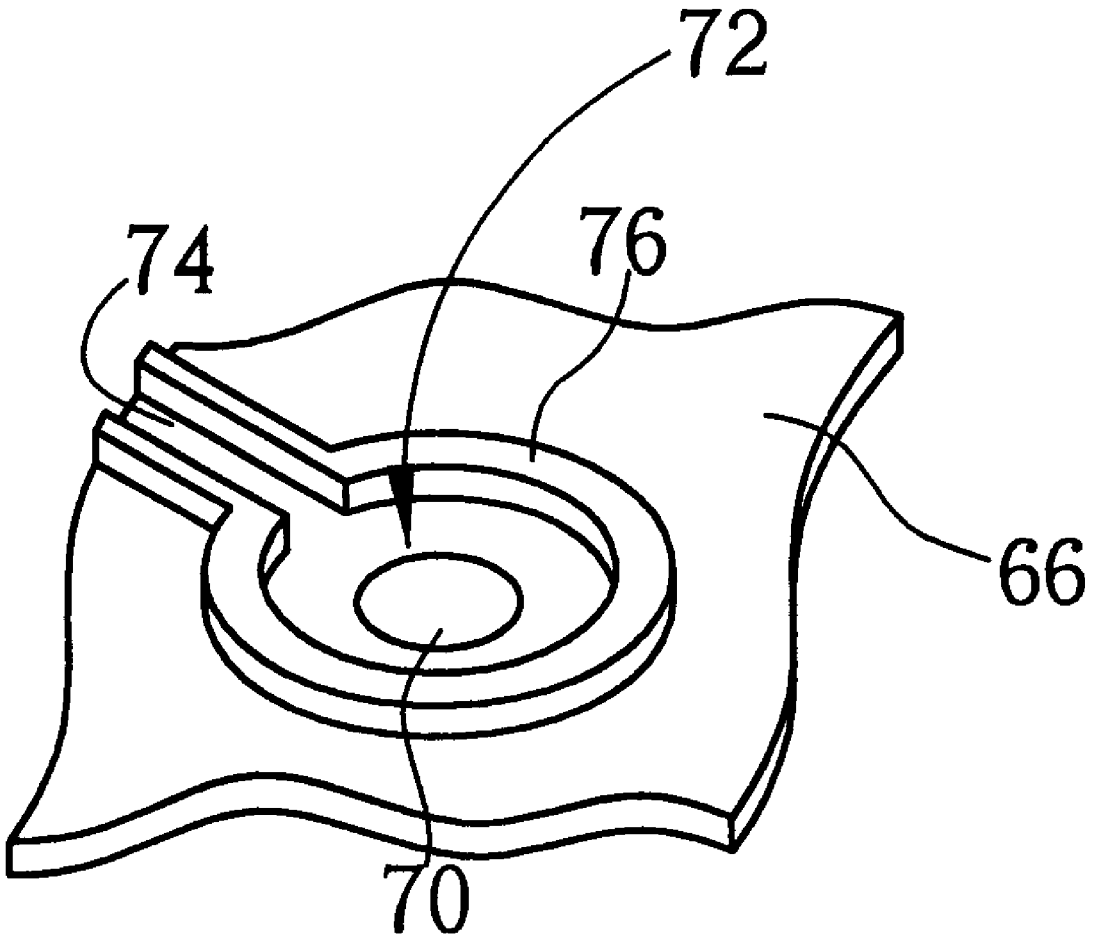
FIG. 5B is a schematic diagram of one of the lower joints shown in FIG. 5A.

Please refer to FIG. 5A and FIG. 5B. FIG. 5A is an exploded diagram of the circuit board 50 of FIG. 4. FIG. 5B is a schematic diagram of one of the lower joints 70 shown in FIG. 5A. The thin film switching circuit 58 of the circuit board 50 includes an upper circuit layer 64, a lower circuit layer 66, and a plurality of first air conduits 74 between the upper circuit layer 64 and the lower circuit layer 66. The upper circuit layer 64 includes a plurality of upper joints 68 on the lower surface of the upper circuit layer 64. The lower circuit layer 66 includes a plurality of lower joints 70 corresponding to the upper joints 68. The lower circuit layer 66 is set under the upper circuit layer 64 so that an air-filled space 72 is formed between each set of corresponding upper joints 68 and lower joints 70. Each first air conduit 74 connects to an air-filled space 72. The thin film switching circuit 58 further includes an isolation material 76 between the upper circuit layer 64 and the lower circuit layer 66 for forming the air-filled space 72 and the first air conduit 74. As shown in FIG. 4, each key structure 56 corresponds to an upper joint 68 so that the key structure 56 engages the upper joint 68 to contact with the corresponding lower joint 70 to generate a key signal, which is then transmitted to the signal receiver 62 by the bus structure 60. The bus structure 60 includes a first end 78 connected to the thin film switching circuit 58 and a second end 80 connected to the signal receiver 62.

Figure 6:
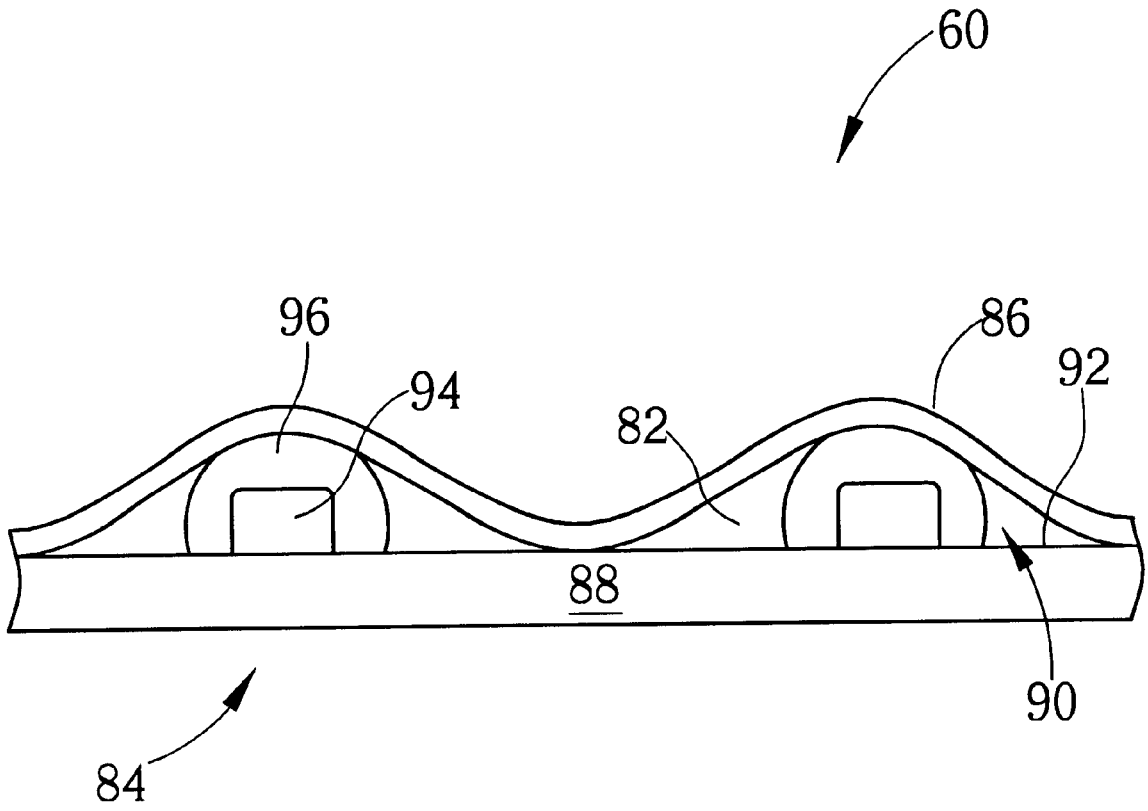
FIG. 6 is a sectional view along a line A–A of a bus structure shown in FIG. 5A.

Please refer to FIG. 6. FIG. 6 is a sectional view along line A—A of the bus structure 60 shown in FIG. 5A. The bus structure 60 includes a bus layer 84 and a protection film 86 covering the bus layer 84, which also includes a base film 88 and a plurality of wire structures 90 on the base film 88. The bus layer 84 and the lower circuit layer 66 of the thin film switching circuit 58 are monolithically formed. The base film 84 includes an upper surface 92. The wire structure 90 protrudes from the upper surface 92 to form a plurality of second air conduits 82 between the bus layer 84 and the protection film 86 along at least one side of the wire structure 90. The second air conduit 82 extends from the first end 78 of FIG. 5A to the second end 80, and connects to the first air conduit 74 on one end and the ambient atmosphere at another end so that the air within the air-filled space 72 flows in and out through the first air conduit 74 and the second air conduit 82.

As shown in FIG. 6, the wire structure 90 includes a conductor 94 for transmitting the key signals, and an isolation layer 96 disposed outside of the conductor 94. The conductor 94 may be a silver wire, a carbon wire, or any other single or hybrid material wire, such as a silver wire covered by a carbon conductor.

Figure 7A:
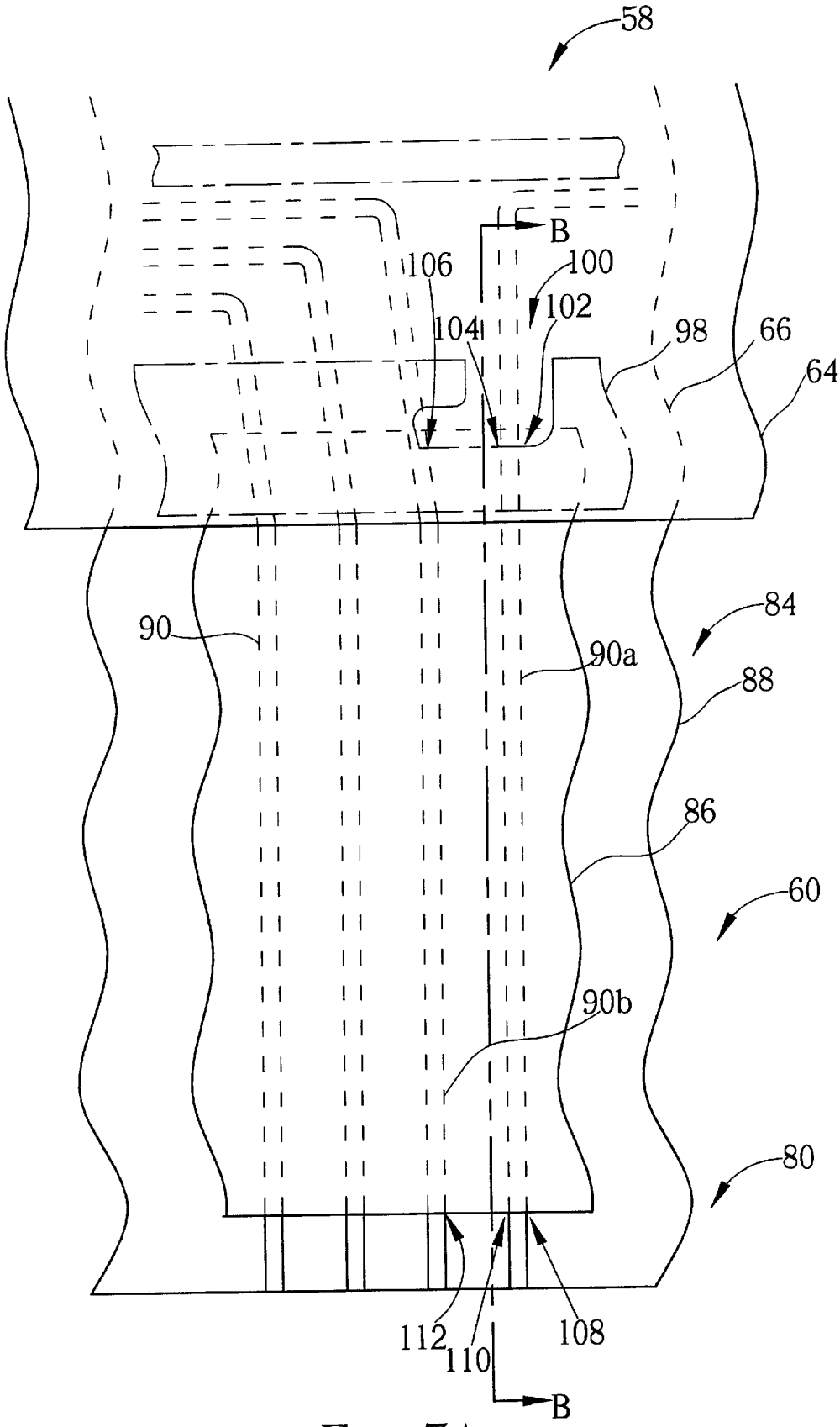
FIG. 7A is a schematic diagram for the bus structure connecting to a thin film switching circuit of FIG. 4.
Figure 7B:
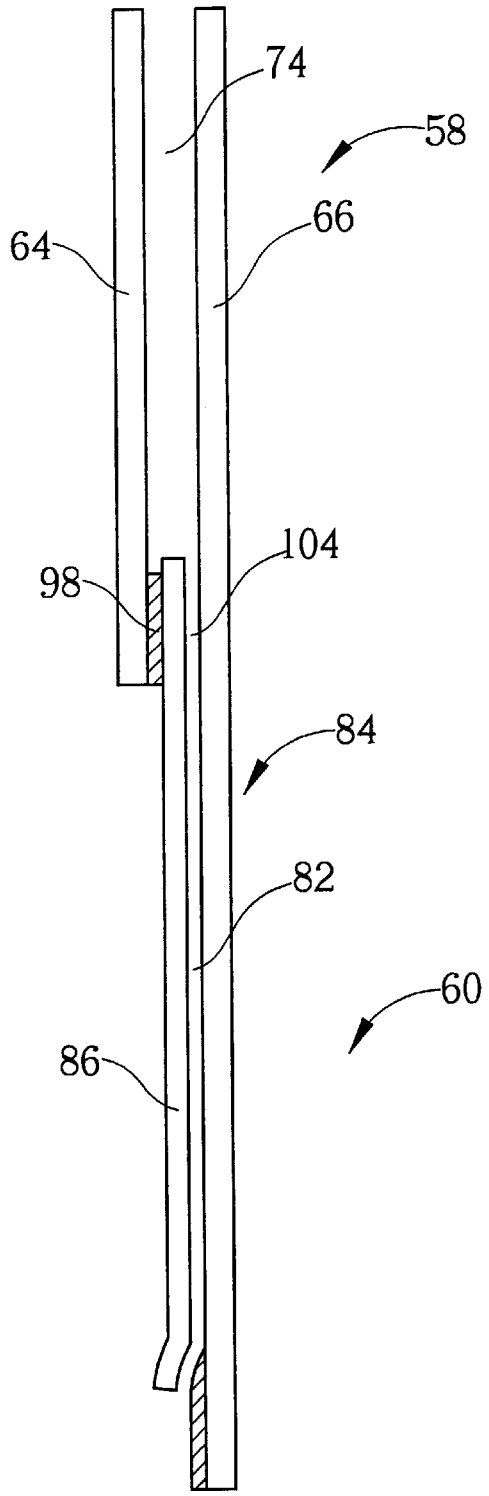
FIG. 7B is a sectional view along a line B—B of the bus structure shown in FIG. 7A.

Please refer to FIG. 7A and FIG. 7B. FIG. 7A is a schematic diagram for the bus structure 60 shown in FIG. 4 connected to the thin film switching circuit 58. FIG. 7B is a sectional view along line B—B of the bus structure 60 shown in FIG. 7A. As shown in FIG. 7A and FIG. 7B, the protection film 86 of the bus structure 60 extends into the spaces between the upper circuit layer 64 and the lower circuit layer 66 of the thin film switching circuit 58. The circuit board 50 further includes a sealing layer 98 located between the upper circuit layer 64 and the lower circuit layer 66 and between the upper circuit layer 64 and the protection film 86. The sealing layer 98 includes an opening 100, across two sides 102 and 104 of the wire structure 90*a* and one side 106 of the wire structure 90*b*. The opening 100 thus connects the two sides 102 and 104 of the wire structure 90*a* and the one side 106 of the wire structure 90*b* to the first air conduit 74. Additionally, the second air conduit 82 also connects to the ambient atmosphere through two sides 108 and 110 of the wire structure 90*a* and one side 112 of the wire structure 90*b*. As a result, the air of the air-filled space 72 of the thin film switching circuit 58 is able to flow in and out through he first air conduit 74 and the second air conduit 82.

Because the second air conduit 82 lets the air flow in and out along the second end 80 far from the thin film switching circuit 58, fluid spilled onto the thin film switching circuit 58 cannot draw back into the air-filled space 72 through the second end 80. Furthermore, the second air conduit 82 is easily manufactured by simply increasing the wire structure 90 to a sufficient height.

Figure 8A:
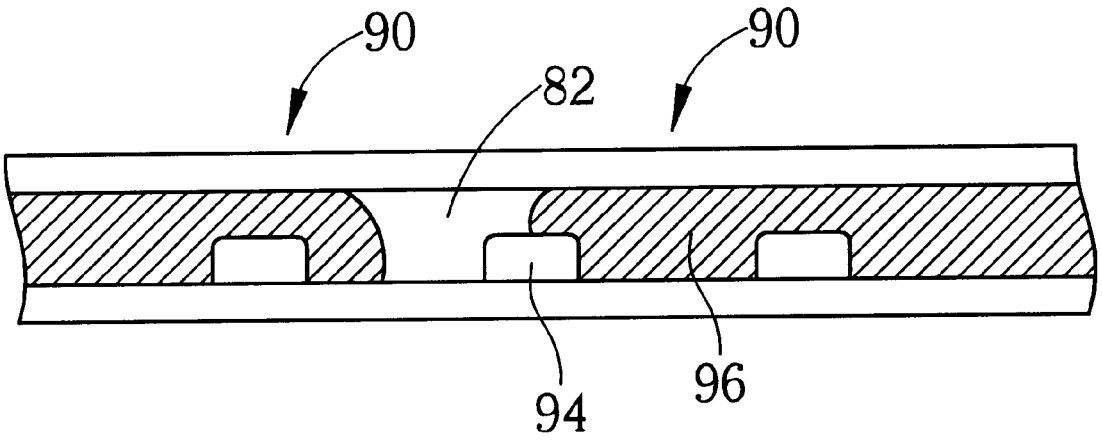
FIG. 8A to FIG. 8C are schematic diagrams of other embodiments of a second air conduit according to the present invention.
Figure 8B:
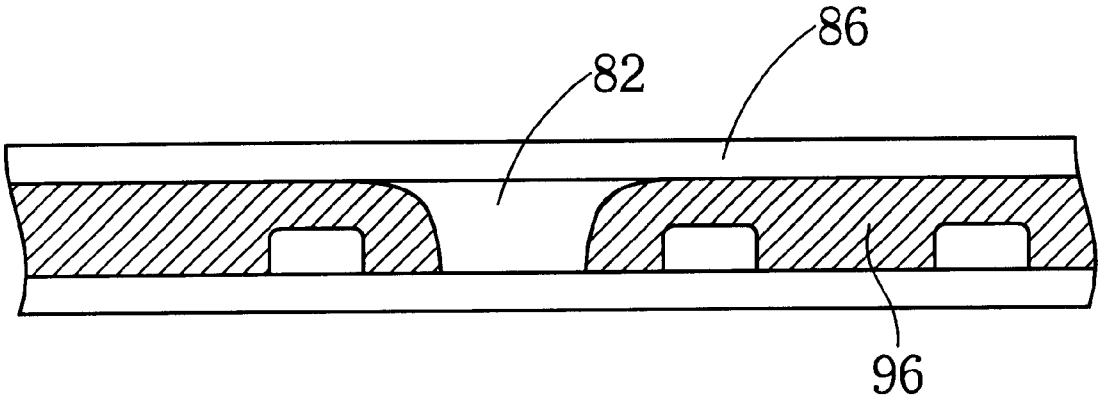
Figure 8C:
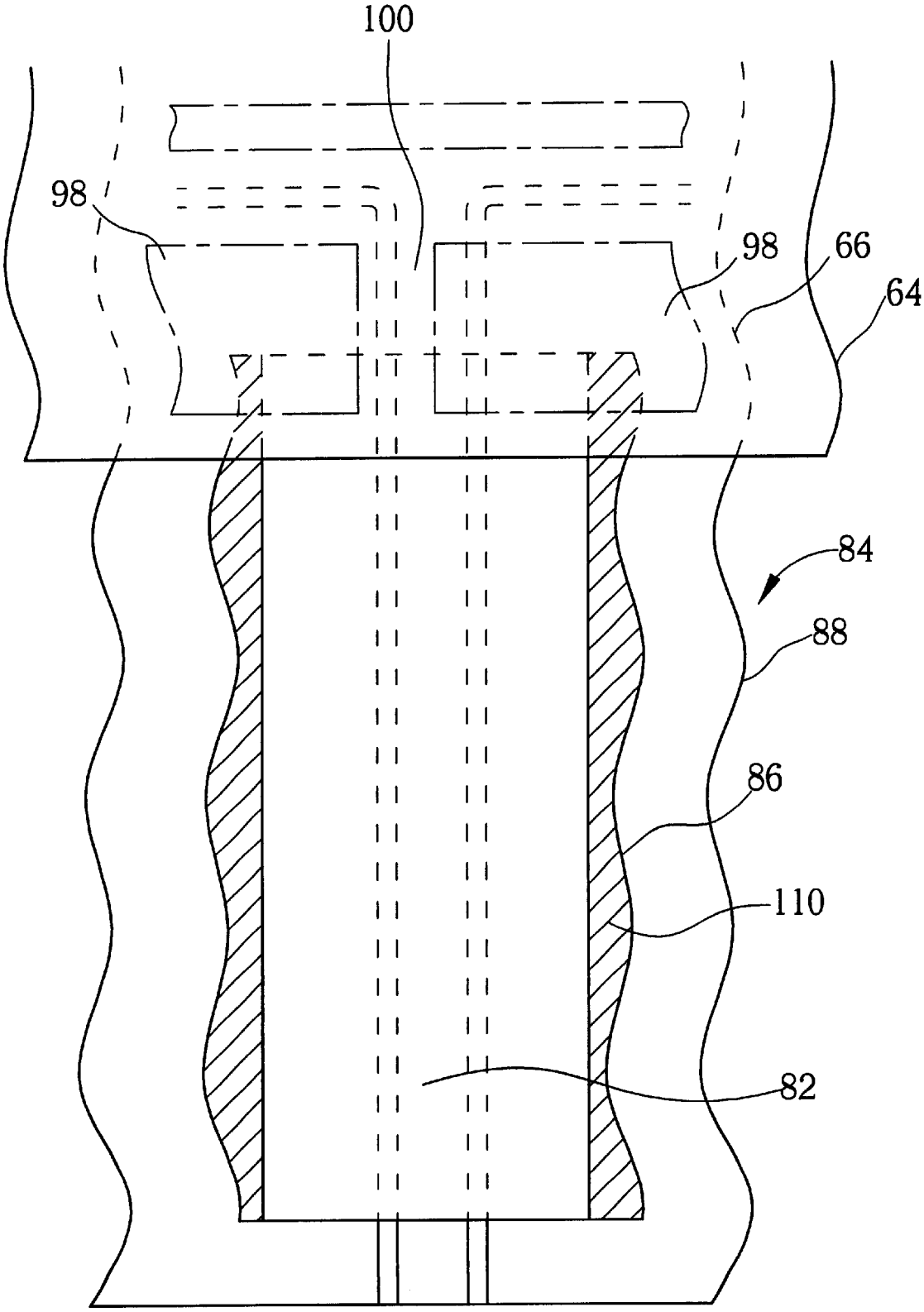

Please refer to FIGS. 8A to 8C. FIGS. 8A to 8*c* are schematic diagrams for other embodiments according to the present invention, and show alternate formations of the second air conduit 82. As shown in FIG. 8A, an isolation layer 96 of the wire structure 90 can stop short of covering the whole part of the conductor 94 to form the second air conduit 82. Referring to FIG. 8B, the second air conduit 82 can be formed by gaps in the isolation layer 96 under the protection layer 86. In fact, the bus layer 84 need only have a corrugated surface with the transversal surface to form the second air conduit 82 between the bus layer 84 and the protection film 86. As shown in FIG. 8C, the second air conduit 82 can occupy nearly the entire space between the bus layer 84 and the protection film 86, the sealing layer 110 being on both sides of the protection layer film 86, and the opening 100 punching through the sealing layer 98. Therefore, the second air conduit 82 is formed by the opening 100 and entire space between the bus layer 84 and the protection film 86.

Former embodiments are based on the case that the bus layer 84 and the lower circuit layer are monolithically formed. Alternatively, the bus layer 84 and the upper circuit layer are possibly monolithically formed. Or, the bus structure 60 includes two bus layers 84, and each of them and the upper circuit layer 64 and the lower circuit layer 66 are monolithically formed respectively while forming the second air conduit 82.

Compared with the prior art, the circuit board 50 according to the present invention includes the second air conduit 82 within the bus structure 60 so that the thin film switching circuit 58 is water-proof while being able to equalize the air pressure of the air-filled spaces 72. The second conduit 82 of the present invention takes advantages of the structure adopted currently and is manufactured by adjusting the height of the wire structure and by producing the appropriate opening 100. Consequently, costs for producing the circuit board 50 are very low.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A thin film circuit comprising:

a thin film switching circuit having:

an upper circuit layer comprising at least one upper joint;

a lower circuit layer comprising at least one lower joint corresponding to the upper joint, wherein the lower circuit layer is set under the upper circuit layer, and an air-filled space is disposed between the upper joint and the lower joint; and at least one first air conduit being set between the upper circuit layer and the lower circuit layer and being connected to the air-filled space; and at least one bus structure being connected to the thin film switching circuit and extending out of the thin film switching circuit to transmit electrical signals of the thin film switching circuit, the bus structure having at least one second air conduit, one end of the second air conduit being connected to ambient atmosphere;

wherein another end of the second air conduit is connected to the first air conduit so that the air in the air-filled space can flow in and out to the ambient atmosphere through the first air conduit and the second air conduit.

2. The circuit of claim 1 wherein the bus structure further comprises a first end connected to the thin film switching circuit, and a second end connected to a signal receiver, the second air conduit extending from the first end to the second end and connected to the ambient atmosphere at the second end.

3. The circuit of claim 1 wherein the bus structure further comprises a bus layer and a protection film covering the bus layer, the bus layer having a corrugated surface with the transversal surface to form the second air conduit between the bus layer and the protection film.

4. The circuit of claim 3 wherein the bus layer comprises:

a base film having an upper surface; and at least one wire structure set on the base film, the wire structure protruding out of the upper surface to form the second air conduit along at least one side of the wire structure.

5. The circuit of claim 4 wherein the wire structure comprises a conductor to transmit signals generated by the thin film circuit.

6. The circuit of claim 5 wherein the wire structure further comprises an isolation layer set outside of the conductor.

7. The circuit of claim 3 wherein the bus layer of the bus structure and the lower circuit layer of the thin film switching circuit are monolithically formed.

8. The circuit of claim 7 wherein the protection film of the bus structure extends into spaces between the upper circuit layer and the lower circuit layer of the thin film switching circuit.

9. The circuit of claim 1 wherein the upper circuit layer comprises a plurality of upper joints corresponding to lower joints of the lower circuit, each set of corresponding upper joints and lower joints forming an air-filled space, and the thin film switching circuit further comprises a plurality of first air conduits to connect to the plurality of air-filled spaces.

10. The circuit of claim 1 wherein the circuit is used for a keyboard, the keyboard comprising at least one key structure corresponding to the upper joint; wherein when the key structure is pressed, the key structure engages the upper joint to contact with the corresponding lower joint to generate a key signal, and the bus structure is used to transmit the key signal.

11. The circuit of claim 10 wherein the bus structure comprises a bus layer and a protection film covering the bus layer, the bus layer having a corrugated surface with the transversal surface to form the second air conduit between the bus layer and the protection film.

12. The circuit of claim 11 wherein the bus layer comprises:

a base film having an upper surface; and at least one wire structure set on the base film, the wire structure protruding out of the upper surface to form the second air conduit along at least one side of the wire structure.

13. The circuit of claim 12 wherein the wire structure comprises a conductor to transmit the key signal.

* * * * *